US007848529B2

(12) United States Patent
Zhang et al.

(10) Patent No.: US 7,848,529 B2
(45) Date of Patent: Dec. 7, 2010

(54) BROADSIDE SMALL ARRAY MICROPHONE BEAMFORMING UNIT

(75) Inventors: Ming Zhang, Cupertino, CA (US); Wan-Chieh Pai, San Jose, CA (US)

(73) Assignee: Fortemedia, Inc., Cupertino, CA (US)

( * ) Notice: Subject to any disclaimer, the term of this patent is extended or adjusted under 35 U.S.C. 154(b) by 904 days.

(21) Appl. No.: 11/622,052

(22) Filed: Jan. 11, 2007

(65) Prior Publication Data

US 2008/0170715 A1 Jul. 17, 2008

(51) Int. Cl.
*H04R 3/00* (2006.01)

(52) U.S. Cl. ..... 381/92; 381/71.11; 381/94.7; 704/233

(58) Field of Classification Search ..... 381/92, 381/97, 111, 71.1, 94.1, 71.11, 94.7; 367/118, 367/125, 126, 129; 704/216, 233, 237
See application file for complete search history.

(56) References Cited

U.S. PATENT DOCUMENTS 5,471,538 A * 11/1995 Sasaki et al. ..... 381/92
5,473,701 A * 12/1995 Cezanne et al. ..... 381/92
6,584,203 B2 * 6/2003 Elko et al. ..... 381/92
6,865,275 B1 * 3/2005 Roeck ..... 381/92
6,983,055 B2 * 1/2006 Luo ..... 381/313
7,003,099 B1 2/2006 Zhang et al.
7,039,193 B2 * 5/2006 Mantegna et al. ..... 381/58
7,212,642 B2 * 5/2007 Rasmussen ..... 381/313
7,409,068 B2 * 8/2008 Ryan et al. ..... 381/313
7,443,989 B2 * 10/2008 Choi et al. ..... 381/92
2005/0195988 A1 9/2005 Tashev et al.
2006/0198538 A1 9/2006 Malvar et al.
2007/0195968 A1 * 8/2007 Jaber ..... 381/71.11

OTHER PUBLICATIONS

PCT International Search Report, Apr. 4, 2008.

* cited by examiner

*Primary Examiner*—Vivian Chin
*Assistant Examiner*—Jason R Kurr
(74) *Attorney, Agent, or Firm*—Thomas, Kayden, Horstemeyer & Risley

(57) ABSTRACT

A broadside small array microphone beamforming unit comprises a first omni-directional microphone to generate a signal X1(*t*), a second omni-directional microphone to generate a signal X2(*t*), a first delay unit delaying the signal X1(*t*) to generate a signal X1(*t*−T), a second delay unit delaying the signal X2(*t*) to generate a signal X2(*t*−T), a first substrator subtracting the signal X1(*t*−T) from the signal X2(*t*) to generate a signal R(t)=X2(*t*)−X1(*t*−T), a second substrator subtracting the signal X2(*t*−T) from the signal X1(*t*) to generate a signal L(t)=X1(*t*)−X2(*t*−T), a third delay unit delaying the signal R(t) to generate a signal R'(t)=R(t−D), a gain function unit convoluting the signal L(t) with a gain function G(t) to generate a signal L'(t)=L(t)*G(t−i), and a substrator subtracting the signal L'(t) from the signal R'(t) to generate a signal B'(t)=R'(t)−L'(t).

15 Claims, 5 Drawing Sheets

400

BROADSIDE SMALL ARRAY MICROPHONE BEAMFORMING UNIT

BACKGROUND OF THE INVENTION

1. Field of the Invention

The invention relates to broadside small array microphone beamforming unit, and in particular to low noise adjustable beams for broadside small array microphone beamforming unit.

2. Description of the Related Art

Many communication system and voice recognition devices are designed for use in noisy environments. Examples of such applications include communication and/or voice recognition in cars or mobile environments (e.g., on street). For these applications, the microphones in the system pick up not only the desired voice but also noise as well. The noise can degrade the quality of voice communication and speech recognition performance if it is not dealt with in an effective manner.

Noise suppression is often required in many communication systems and voice recognition devices to suppress noise to improve communication quality and voice recognition performance. Noise suppression may be achieved using various techniques, which may be classified as single microphone techniques and array microphone techniques.

Single microphone noise reduction techniques typically use spectral subtraction to reduce the amount of noise in a noisy speech signal. With spectral subtraction based techniques, the power spectrum of the noise is estimated and then subtracted from the power spectrum of the noisy speech signal. The phase of the resultant enhanced speech signal is maintained equal to the phase of the noisy speech signal so that the speech signal is minimally distorted. The spectral subtraction based techniques are effective in reducing stationary noise but are not very effective in reducing non-stationary noise. Moreover, even for stationary noise reduction, these techniques can cause distortion in the speech signal at low signal-to-noise ratio (SNR).

Array microphone noise reduction technique use multiple microphones that are placed at different locations and are separated from each other by some minimum distance to form a beam. Conventionally, the beam is used to pick up speech that is then used to reduce the amount of noise picked speech that is then used to reduce the amount of noise picked up outside of the beam. Thus, the array microphone techniques can suppress non-stationary noise. Multiple microphones, however, also create more noise due to the number of microphones.

Thus, effective suppression of noise in communication system and voice recognition devices is desirable.

BRIEF SUMMARY OF THE INVENTION

A detailed description is given in the following embodiments with reference to the accompanying drawings.

An embodiment of a broadside small array microphone beamforming unit for adjusting a beam direction and reducing internal noise in a reference channel is provided. The broadside small array microphone beamforming unit comprises a first omni-directional microphone responding to input to generate a first signal X1(*t*), a second omni-directional microphone responding to input to generate a second signal X2(*t*), a first delay unit delaying the first signal X1(*t*) by a period T to generate a third signal X1(*t*−T), a second delay unit delaying the second signal X2(*t*) by the period T to generate a fourth signal X2(*t*−T), a first substrator subtracting the third signal X1(*t*−T) from the second signal X2(*t*) to generate a fifth signal R(t)=X2(*t*)−X1(*t*−T), a second substrator subtracting the fourth signal X2(*t*−T) from the first signal X1(*t*) to generate a sixth signal L(t)=X1(*t*)−X2(*t*−T), a third delay unit delaying the fifth signal R(t) by D samples to generate a seventh signal R'(t)=R(t−D), a gain function unit convoluting the sixth signal L(t) with a gain function G(t) to generate an eighth signal L'(t)=L(t)*G(t−i) and a substrator subtracting the eighth signal L'(t) from the seventh signal R'(t) to generate a ninth signal B'(t)=R'(t)−L'(t).

An embodiment of a broadside small array microphone beamforming unit for adjusting a beam direction and reducing internal noise in a reference channel is provided. The broadside small array microphone beamforming unit comprises a first voice activity detector VAD1 detecting the correlation between a first signal A(t) and a second signal B'(t) to generate a correlated signal V1(*t*), a second voice activity detector VAD2 detecting the non-correlation between the first signal A(t) and the second signal B'(t) to generate a non-correlated signal V2(*t*), a first delay unit delaying the second signal B'(t) by D1 samples to generate a third signal B'(t−D1), a second delay unit delaying the second signal B'(t) by D2 samples to generate a fourth signal B'(t−D2), a first adaptive filter suppressing correlated components and leaving non-correlated components between the first signal A(t) and the third signal B'(t−D1) to generate a fifth signal C(t) according to the correlated signal V1(*t*) and a second adaptive filter suppressing non-correlated components between the fourth signal B'(t−D2) and the fifth signal C(t) to generate a sixth signal B"(t) according to the non-correlated signal V2(*t*).

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
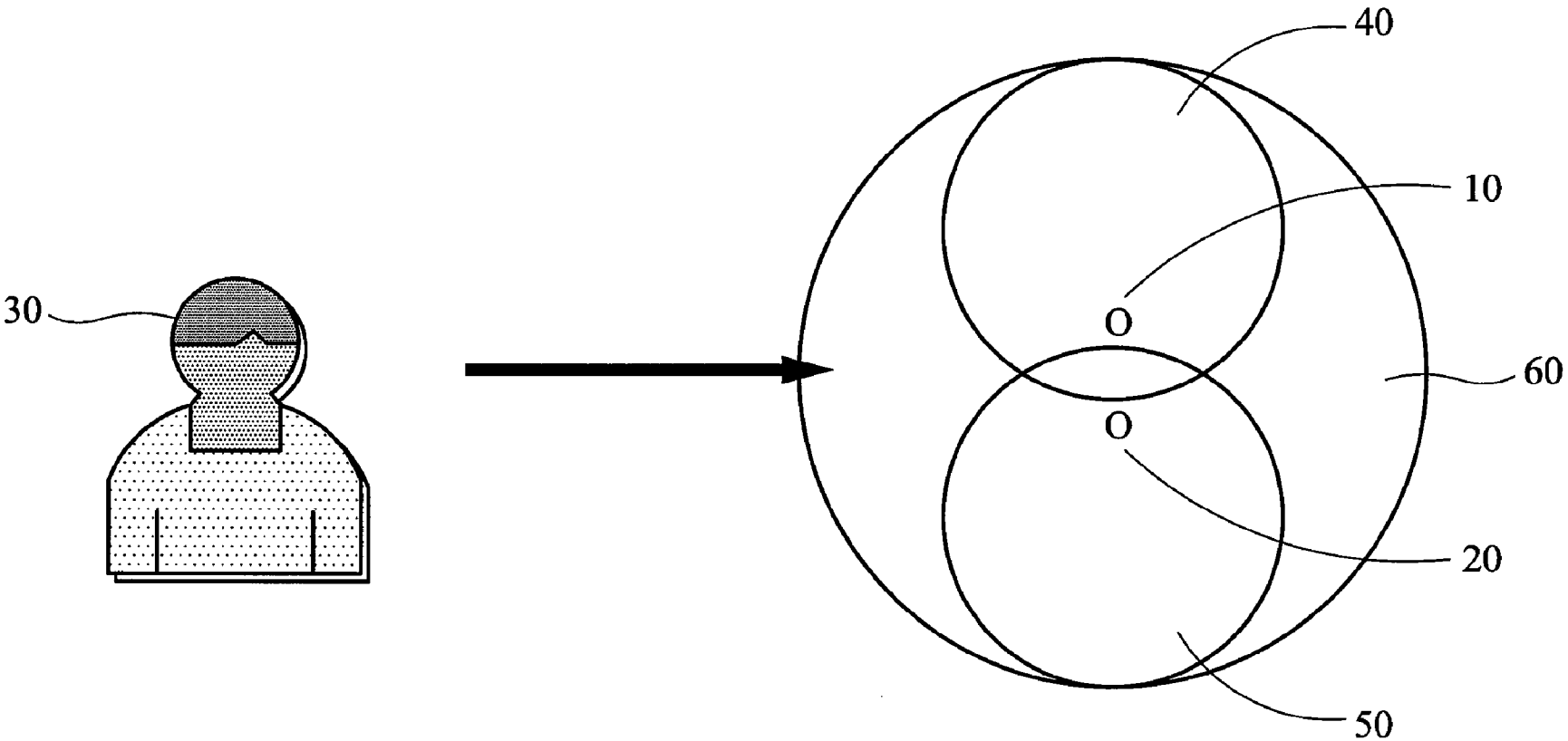
FIG. 1 is a schematic diagram of a beamforming mechanism for a broadside small array microphone according to an embodiment of the invention.

FIG. 1 is a schematic diagram of a beamforming mechanism for a broadside small array microphone according to an embodiment of the invention. As shown in FIG. 1, two omni-directional microphones 10 and 20 are co-disposed and separated to form two channels, a reference channel and main channel, for beamforming. The sum of the two signals generated by the two omni-directional microphones 10 and 20 is used as the main channel with omni-directional lobe 60. A signal generated by one of microphones 10 and 20 can be used as the main channel. Omni-directional microphones 10 and 20 can form two directional microphones with single main lobes 40 and 50, with one directional microphone with single lobe 40 or 50 pointed to the left and the other to the right. The two directional microphones with single main lobes can further form a bi-directional microphone as the reference channel. Signal source 30 is located at the cross point of the two single main lobes 40 and 50 or the null of the bi-directional microphone. In this invention, the bi-directional microphone is used as a reference and one of the omni-directional microphones is used as main channel to form a narrow beam facing the signal source 30.

During formation of bi-directional microphones with single main lobes by using omni-directional microphones, extra noise is generated in the reference channel, particularly at low frequencies. This couples noise to the main channel to affect voice quality and degrade noise suppression in beamforming. In addition, the null of the bi-directional microphone determines the beam direction. In this case, the beam is fixed, which may not be suitable for some applications. In the invention, the beam is adjustable for specific applications.

Figure 2:
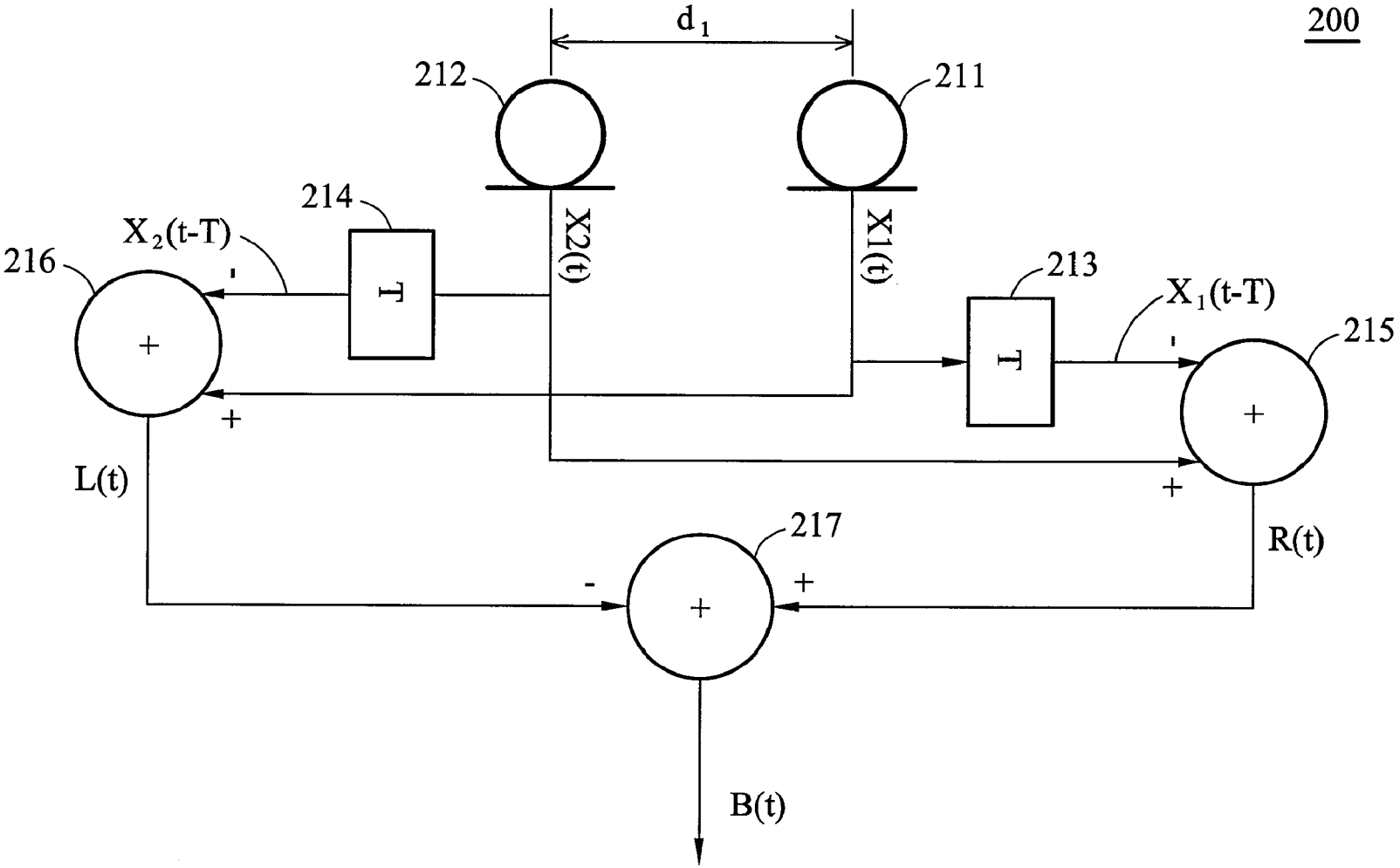
FIG. 2 is a schematic diagram of a reference channel beamforming unit according to an embodiment of the invention.

FIG. 2 is a schematic diagram of reference channel beamforming unit 200 according to an embodiment of the invention. Two omni-directional microphones 211 and 212 form two directional microphones with single main lobes, one pointing left and the other right. Omni-directional microphones 211 and 212 are at different positions separated by distance d1, respectively generating signals X1(*t*) and X2(*t*) according to input voice. Delay unit 213 receives signal X1(*t*) and delays signal X1(*t*) by period T to generate signal X1(*t*−T). Delay unit 214 receives signal X2(*t*) and delay signal X2(*t*) by period T to generate signal X2(*t*−T). Substrator 215 subtracts signal X1(*t*−T) from X2(*t*) to generate signal R(t) =X2(*t*)−X1(*t*−T). Signal R(t) is the signal for the directional microphone pointing right. Substrator 216 subtracts signal X2(*t*−T) from X1(*t*) to generate signal L(t)=X1(*t*)−X2(*t*−T). Signal L(t) is the signal for the directional microphone pointing left. The polar patterns of these two directional microphones are determined by delay time T. Substrator 217 subtracts signal L(t) from R(t) to get reference channel signal B(t)=R(t)−L(t) for the bi-directional microphone. However, the null of the directional microphones is fixed, i.e., the direction of the polar patterns is vertical to the line link two microphones. Moreover, forming the bi-directional microphone in this way will cause more noise because the internal noise of the two microphones is independent, i.e., the internal noise cannot be cancelled in the process to form the bi-directional microphone. In addition, due to the low frequency component loss in the bi-directional microphone formation, low frequency component requires boosting. In such case, the low frequency noise will also be boosted accordingly and therefore the SNR at low frequencies becomes much lower.

Figure 3:
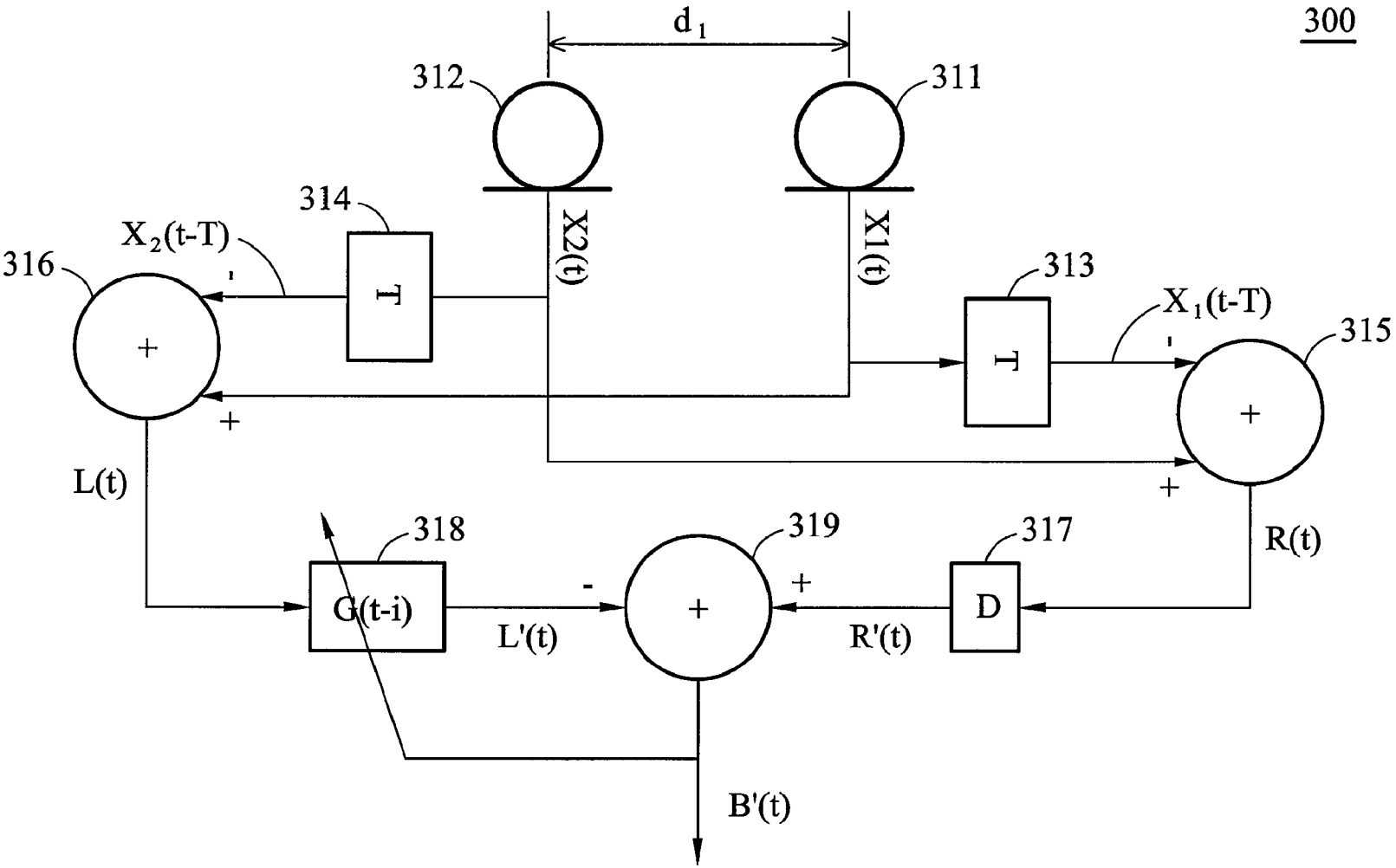
FIG. 3 is a schematic diagram of a reference channel beamforming unit according to another embodiment of the invention.

FIG. 3 is a schematic diagram of reference channel beamforming unit 300 according to another embodiment of the invention. Reference channel beamforming unit 300 in FIG. 3 is modified from reference channel beamforming unit 200 in FIG. 2 for adjusting the beam direction to certain range in order to avoid suppression of the desired voice. Two omni-directional microphones 311 and 312 form two directional microphones with single main lobes, one pointing left and the other right. Omni-directional microphones 311 and 312 at different positions are separated by distance d1 and respectively generate signals X1(*t*) and X2(*t*) according to input voice. Delay unit 313 receives signal X1(*t*) and delays signal X1(*t*) by period T to generate signal X1(*t*−T). Delay unit 314 receives signal X2(*t*) and delay signal X2(*t*) by period T to generate signal X2(*t*−T). Substrator 315 subtracts signal X1(*t*−T) from X2(*t*) to generate signal R(t)=X2(*t*)−X1(*t*−T). Signal R(t) is the signal for the directional microphone pointing right. D-sample delay unit 317 delay signal R(t) by D samples to get signal R'(t)=R(t−D). Gain function unit 318 convolutes signal L(t) with a gain function G(t) to generate signal L'(t)=L(t)*G(t−i). Substrator 319 subtracts signal L'(t) from R'(t) to generate reference channel signal B'(t)=R'(t)−L'(t). The gain function G(i) is updated by signal B'(t) by any adaptive filtering algorithm. In one embodiment of the invention, the gain function G(i) is adjusted according to reference channel signal B'(t) to minimize signal B'(t). In another embodiment of the invention, some constrains are also added into the gain function G(t), to limit variations, i.e., Th1(*i*)<‖G(t−i)‖<Th2(*i*). Th(i) is a constrain function, for example, for D=1, three taps of G(t−i), Th1(*i*)=[0.1, 0.5, 0.1], and Th2(*i*)=[0.2, 1.5, 0.2].

Figure 4:
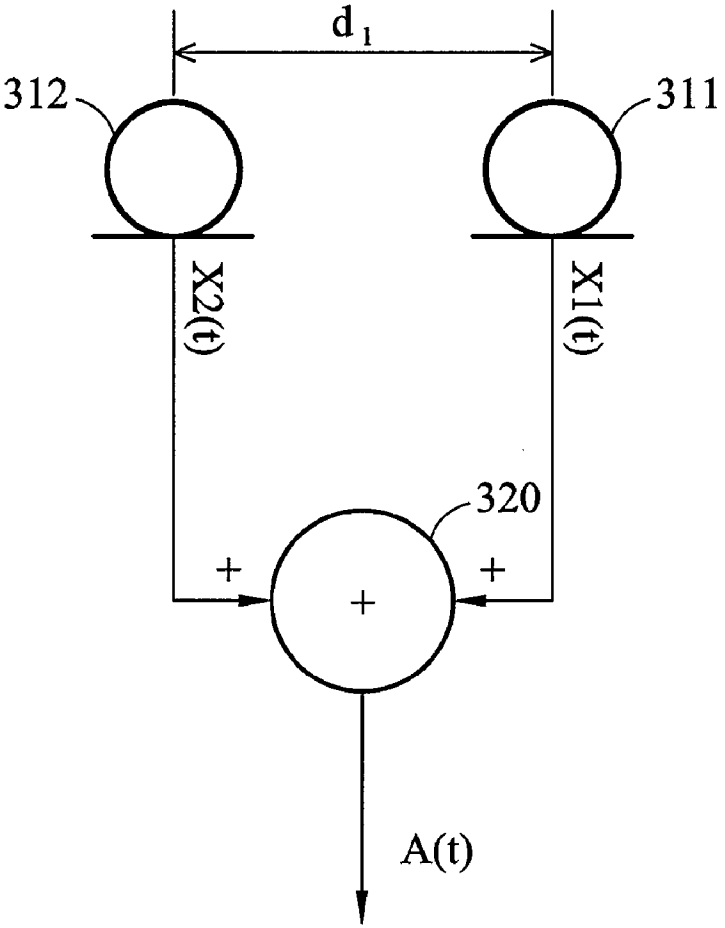
FIG. 4 is a schematic diagram of a main channel beamforming unit according to another embodiment of the invention.

FIG. 4 is a schematic diagram of main channel beamforming unit 400 according to another embodiment of the invention. Omni-directional microphones 311 and 312 respectively generate signals X1(*t*) and X2(*t*). Adder 320 adds signal X1(*t*) and signal X2(*t*) to generate main channel signal A(t). In another embodiment, signal generated by one of two omni-directional microphones 311 or 312 is used as the main channel (not shown in FIG. 4).

Figure 5:
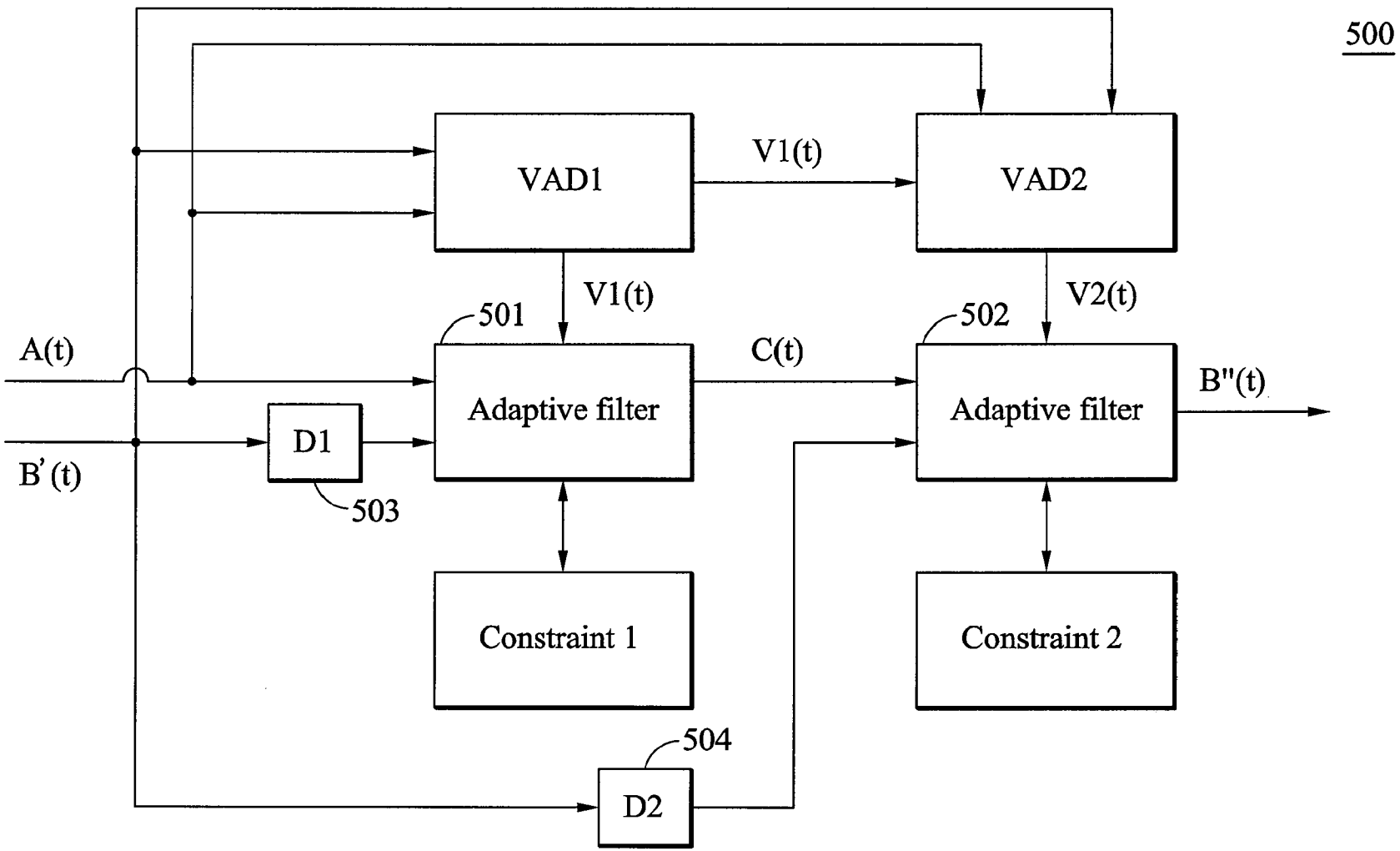
FIG. 5 is a schematic diagram of a reference channel beamforming unit according to another embodiment of the invention.

FIG. 5 is a schematic diagram of reference channel beamforming unit 500 according to another embodiment of the invention. Reference channel beamforming unit 500 reduces internal noise in the formed bi-directional microphone to improve reference channel signal B"(t) for beamforming. Main channel signal A(t) is sent to adaptive filter 501, voice activity detectors VAD1 and VAD2. Reference channel signal B'(t) is sent to delay units 503 and 504 and voice activity detectors VAD1 and VAD2. Delay unit 503 delays reference channel signal B'(t) by D1 samples to generate signal B'(t−D1) and then sent signal B'(t−D1) to adaptive filter 501. Delay unit 504 delays reference channel signal B'(t) by D2 samples to generate signal B'(t−D2) and then sent signal B'(t−D2) to adaptive filter 502. In one embodiment of the invention, delay sample D2 is larger than delay sample D1. Voice activity detectors VAD1 and VAD2 detect the correlation between reference signal B'(t) and main channel signal A(t). For example, VAD1=1 means the presence of the correlated signals between the main channel signal A(t) and reference channel signal B'(t). Adaptive filter 501 receives main channel signal A(t) and signal B'(t−D1) and filters the two signals to provide signal C(t) which suppresses correlated components and leaves non-correlated components between main channel signal A(t) and signal B'(t−D1) according to correlated signal V1(*t*). Constraint 1 is added to adaptive filter 501 to reduce residual desired voice. The specific constraint in Constraint 1 is |C(t)|<|B'(t−D1)|. Since the internal noise of the two microphones is non-correlated and most voice is correlated, the internal noise can be kept and voice is suppressed in signal C(t). Both signal C(t) and signal B"(t−D2) are sent to adaptive filter 502. Adaptive filter 502 is controlled by voice activity detector VAD2. Here voice activity detector VAD2 indicates the presence of non-correlated noise only. Constraint 2 is added to adaptive filter 502 to limit the over adaptation to improve noise suppression. The specific constraint in Constraint 2 is W(i)=W(i)/‖W(i)‖. Adaptive filter 502 filters signal C(t) and signal B"(t−D2) to provide reference channel signal B"(t) with suppressed internal non-correlated noise.

The invention provides a reference channel beamforming unit to reduce internal noise in a reference channel, reducing noise coupling and enhancing beamforming performance, particularly at low frequencies, and introduces a parameter T to adjust the beam direction for a certain range, enhancing flexibility and reducing degradation of the desired sound.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A broadside small array microphone beamforming unit for adjusting a beam direction and reducing internal noise in a reference channel, comprising a first omni-directional microphone responding to input to generate a first signal X1(*t*);

a second omni-directional microphone responding to input to generate a second signal X2(*t*);

a first delay unit delaying the first signal X1(*t*) by a period T to generate a third signal X1(*t*−T);

a second delay unit delaying the second signal X2(*t*) by the period T to generate a fourth signal X2(*t*−T);

a first subtractor subtracting the third signal X1(*t*−T) from the second signal X2(*t*) to generate a fifth signal R(t)=X2(*t*)−X1(*t*−T);

a second subtractor subtracting the fourth signal X2(*t*−T) from the first signal X1(*t*) to generate a sixth signal L(t)=X1(*t*)−X2(*t*−T);

a third delay unit delaying the fifth signal R(t) by D samples to generate a seventh signal R'(t)=R(t−D);

a gain function unit convoluting the sixth signal L(t) with a gain function G(t) to generate an eighth signal L'(t)=L(t)*G(t−i);

a subtractor subtracting the eighth signal L'(t) from the seventh signal R'(t) to generate a ninth signal B'(t)=R'(t)−L'(t)

an adder to add the first signal X1(*t*) and the second signal X2(*t*) to generate a tenth signal A(t)=X1(*t*)+X2(*t*);

a first voice activity detector VAD1 detecting the correlation between the tenth signal A(t) and the ninth signal B'(t) to generate a correlated signal V1(*t*);

a second voice activity detector VAD2 detecting the non-correlation between the tenth signal A(t) and the ninth signal B'(t) to generate a non-correlated signal V2(*t*);

a fourth delay unit delaying the ninth signal B'(t) by D1 samples to generate an eleventh signal B'(t−D1);

a fifth delay unit delaying the ninth signal B'(t) by D2 samples to generate a twelfth signal B'(t−D2);

a first adaptive filter suppressing correlated components and leaving non-correlated components between the tenth signal A(t) and the eleventh signal B'(t−D1) to generate a thirteenth signal C(t) according to the correlated signal V1(*t*); and a second adaptive filter suppressing non-correlated components between the twelfth signal B'(t−D2) and the thirteenth signal C(t) to generate a fourteenth signal B"(t) according to the non-correlated signal V2(*t*).

2. The broadside small array microphone beamforming unit as claimed in claim 1, wherein the gain function G(t) is adjusted according to the ninth signal B'(t).

3. The broadside small array microphone beamforming unit as claimed in claim 2, wherein the gain function G(t) is adjusted according to the ninth signal B'(t) to minimize the ninth signal B'(t).

4. The broadside small array microphone beamforming unit as claimed in claim 1, wherein the first adaptive filter has a first constraint whereby the absolute value of the thirteenth signal is smaller than the absolute value of the eleventh signal |C(t)|<|B'(t−D1)|.

5. The broadside small array microphone beamforming unit as claimed in claim 1, wherein the second adaptive filter has a second constraint W(i)=W(i)/||W(i)||.

6. The broadside small array microphone beamforming unit as claimed in claim 1, wherein the first omni-directional microphone and the second omni-directional microphone are located at different positions separated by a set distance.

7. A broadside small array microphone beamforming unit for adjusting a beam direction and reducing internal noise in a reference channel, comprising:

a first voice activity detector VAD1 detecting the correlation between a first signal A(t) and a second signal B'(t) to generate a correlated signal V1(*t*);

a second voice activity detector VAD2 detecting the non-correlation between the first signal A(t) and the second signal B'(t) to generate a non-correlated signal V2(*t*);

a first delay unit delaying the second signal B'(t) by D1 samples to generate a third signal B'(t−D1);

a second delay unit delaying the second signal B'(t) by D2 samples to generate a fourth signal B'(t−D2);

a first adaptive filter suppressing correlated components and leaving non-correlated components between the first signal A(t) and the third signal B'(t−D1) to generate a fifth signal C(t) according to the correlated signal V1(*t*); and a second adaptive filter suppressing non-correlated components between the fourth signal B'(t−D2) and the fifth signal C(t) to generate a sixth signal B"(t) according to the non-correlated signal V2(*t*).

8. The broadside small array microphone beamforming unit as claimed in claim 7, wherein the first adaptive filter has a first constraint whereby the absolute value of the fifth signal is smaller than the absolute value of the third signal |C(t)|<|B'(t−D1)|.

9. The broadside small array microphone beamforming unit as claimed in claim 7, wherein the second adaptive filter has a second constraint W(i)=W(i)/||W(i)||.

10. The broadside small array microphone beamforming unit as claimed in claim 7, wherein the first signal A(t) and the second signal B(t) are generated by a processing unit which receives signals from two omni-directional microphones.

11. The broadside small array microphone beamforming unit as claimed in claim 10, wherein the processing unit comprises:

a first omni-directional microphone responding to input to generate a seventh signal X1(*t*);

a second omni-directional microphone responding to input to generate an eighth signal X2(*t*);

a third delay unit delaying the seventh signal X1(*t*) by a period T to generate a ninth signal X1(*t*−T);

a fourth delay unit delaying the eighth signal X2(*t*) by the period T to generate a tenth signal X2(*t*−T);

a first subtractor subtracting the ninth signal X1(*t*−T) from the eighth signal X2(*t*) to generate an eleventh signal R(t)=X2(*t*)−X1(*t*−T);

a second subtractor subtracting the tenth signal X2(*t*−T) from the seventh signal X1(*t*) to generate a twelfth signal L(t)=X1(*t*)−X2(*t*−T);

a fifth delay unit delaying the eleventh signal R(t) by D samples to generate a thirteenth signal R'(t)=R(t−D);

a gain function unit convoluting the twelfth signal L(t) with a gain function G(t) to generate an fourteenth signal L'(t)=L(t)*G(t−i); and a subtractor subtracting the fourteenth signal L'(t) from the thirteenth signal R'(t) to generate the second signal B'(t) =R'(t)−L'(t).

12. The broadside small array microphone beamforming unit as claimed in claim 11, wherein the gain function G(t) is adjusted according to the signal B'(t).

13. The broadside small array microphone beamforming unit as claimed in claim 12, wherein the gain function G(t) is adjusted according to the ninth signal B'(t) to minimize the ninth signal B'(t).

14. The broadside small array microphone beamforming unit as claimed in claim 11, further comprising an adder to add the seventh signal X1(*t*) and the eighth signal X2(*t*) to generate the first signal A(t)=X1(*t*)+X2(*t*).

15. The broadside small array microphone beamforming unit as claimed in claim 11, wherein the first omni-directional microphone and the second omni-directional microphone are located at different positions separated by a set distance.

* * * * *